United States Patent [19]

Guim

[11] 4,275,325

[45] Jun. 23, 1981

[54] FLUORESCENT LAMP WITH PLURAL SEALED ENCLOSURES AND ELECTRICAL CONNECTOR THEREFOR

[76] Inventor: Raul Guim, 834 Venetia, Coral Gables, Fla. 33134

[21] Appl. No.: 66,128

[22] Filed: Aug. 13, 1979

[51] Int. Cl.[3] ..... H01J 61/30; H01J 61/36; H01R 29/00; H01R 33/76

[52] U.S. Cl. ..... 313/51; 313/493; 339/145 D; 339/31 L

[58] Field of Search ..... 313/51, 493; 339/50 R (U.S. only), 145 D, 31 L, 145 R, 154 L, 155 L

[56] References Cited

U.S. PATENT DOCUMENTS

| | | | |
|---|---|---|---|
| 1,974,888 | 9/1934 | Barclay | 313/51 X |
| 2,659,835 | 11/1953 | Germer | 339/31 L X |
| 2,993,191 | 7/1961 | Pietzsch et al. | 339/145 D |

*Primary Examiner*—Palmer C. Demeo
*Attorney, Agent, or Firm*—Jesus Sanchelima

[57] ABSTRACT

A fluorescent lamp having a longitudinal divider forming at least two enclosures inside its cylindrical glass envelope. Each enclosure has a set of electrodes on each end in a similar fashion as regular fluorescent lamps do. The end cap is provided with the corresponding electrodes terminals for each enclosure. An end cap connector is removably attached to the end cap providing for the corresponding contacts for the electrode terminals on the inside of said connector and the outside being capable of mating with commercially available sockets for fluorescent lamps.

6 Claims, 9 Drawing Figures

FLUORESCENT LAMP WITH PLURAL SEALED ENCLOSURES AND ELECTRICAL CONNECTOR THEREFOR

BACKGROUND OF THE INVENTION

1. Field of the Invention

This invention relates to an improvement for fluorescent lamps capable of enlarging its useful life by incorporating a plurality of hermetically sealed enclosures acting as independent lamps.

2. Description of the Prior Art

In preparing fluorescent lamp tubes, it is the practice to coat the filament of the electrodes with a suspension of strontium and barium carbonates and zirconia or powdered zirconium in which suspension the coils are dipped and when the coils are heated to activate them in service, the carbonates are decomposed to form a coating consisting of a mixture of barium and strontium oxides, or a mixture of barium and strontium oxides and zirconia or zirconium. There is also enclosed in the tubes a small amount of mercury and as inert gas, such as argon, krypton, or a mixture of argon and krypton, and when an electric current is passed between the electrodes, ultra-violet radiations are produced which are transformed by the fluorescent material into visible light.

The complete failure of gas-filled tubes, unless defects are present in their mechanical parts, is generally due to the sputtering off of all of the coating upon the filaments of the electrodes. However, it is well known that gas-filled tubes of the fluorescent type gradually blacken in service even when the coating of the oxides upon the filaments is still intact. The blackening of the tubes is particularly pronounced at the end portions of the tubes in proximity to the electrodes although more or less blackening of the tubes occurs throughout the entire length of the tubes. This blackening is caused by a film comprising mercury which is deposited upon the interior surface of the tube during service which the mercury may be entrained with or combined with other elements or compounds on the interior surface of the tube.

Several attempts have been made in the past to recondition gas filled lamps, and more particularly, fluorescent lamps. One of these attempts is described and claimed by Louis C. Stringer in U.S. Pat. No. 2,304,714. However, even though the gas inside the lamp is changed like in the present invention, it is done by breaking the glass tube and fusing the edges together afterwards. This method is costly, time consuming and impractical.

Another method and apparatus of interest is described in U.S. Pat. No. 2,884,298 issued to Thomas T. Bryen. This method and apparatus involves the use of heat to get rid of the blackening of the tubes. Again, this method and apparatus is very cumbersome and impractical.

Still another approach is described in U.S. Pat. No. 2,733,973 issued to Wallace Shaffer. Here, a high voltage is applied, between 5,000 and 12,000 volts, with a load current between 1 and 12 milliamperes, in order to "rejuvenate" the lamp tube. This invention requires the use of a high voltage generator and its operation may be quite dangerous. Furthermore, it is not effective in all cases as the inventor himself admits in said patent specification that it is not known with certainty what transpires in the tubes when a high voltage is applied to it.

None of these patents, however, provide for an easy solution to the user. Most of the prior art requires the use of complicated rejuvenating equipment. The user, on the other hand, wants a fast solution and it is that what the present invention gives him. The user can easily rotate the end cap on each end of the tube and the problem is fixed.

Other related inventions have been studied as part of the prior art. None of these inventions anticipate the novel features of the present invention.

SUMMARY OF THE INVENTION

It is the object of the present invention to provide a fluorescent lamp capable of housing a plurality of independent lamp assemblies so that when one of them burns out, another lamp may be readily activated.

It is another object of the present invention to enlarge the useful life of a fluorescent lamp.

The invention also comprises such other objects, advantages and capabilities as will later more fully appear and which are inherently possessed by the invention.

BRIEF DESCRIPTION OF THE DRAWINGS

The advantages and novel features of the present invention will become apparent from the following detailed description of preferred embodiments of the invention illustrated in the accompanying drawings where.

DETAILED DESCRIPTION OF THE PREFERRED EMBODIMENT

Figure 1:
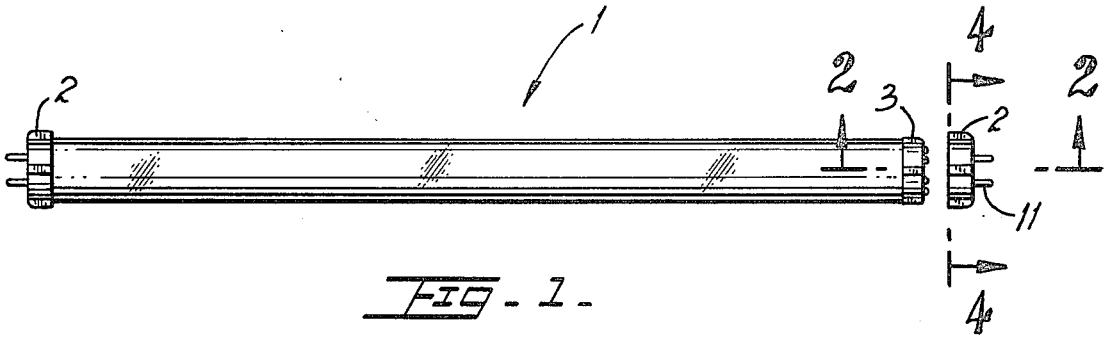
FIG. 1 shows the dual fluorescent lamp subject of the present application, with the right end cap separated from the tube.

Referring to FIG. 1, where a dual fluorescent lamp 1 is shown with one of its end cap connectors 2 separated, it can be readily seen that the present invention may be embodied in standard commercially available fluorescent lamps.

Figure 2:
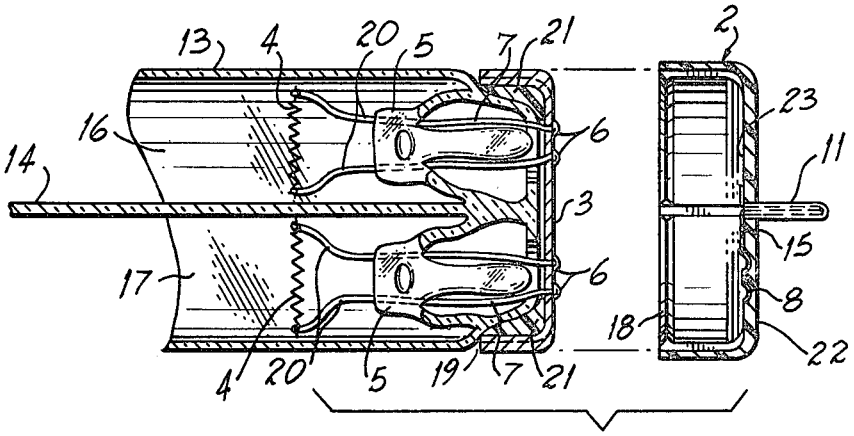
FIG. 2 is a partial cross-section of the tube in FIG. 1 along line 2—2.
Figure 3:
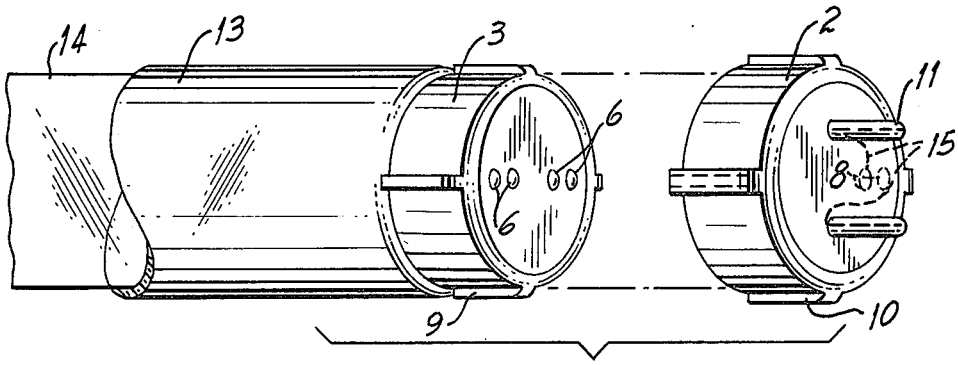
FIG. 3 is a partial view in perspective of the end of the lamp tube, with the end cap separated.

In FIG. 2 a cross-section of one end of dual lamp 1 is shown illustrating the preferred embodiment for the present invention as it is incorporated in a standard two pin lamp. The method of operation for fluorescent lamp is old. A voltage is applied to the two contact pins 11 which are connected through conductors 15 to contacts 8. Contacts 8 engage with electrode terminals 6 which in turn are connected through electrode wires 7 to filament 4. The glass envelope 13, hermetically sealed, contains a rarified atmosphere that is ionized when filament 4 is heated. The filament 4 and electrode wires 7 are referred to, collectively, as an electrode assembly 20. The ions are electrostatically accelerated inside the glass envelope 13. The inside wall of glass envelope 13 is covered with fluorescent material that is activated when the ions strike said inside wall.

The embodiment disclosed uses four electrode assemblies 20 and two independent glass envelopes which we refer to as lamp enclosure A 16 and lamp enclosure B 17. It is possible to have more than two independent lamp enclosures incorporated in the present invention with the consequent extension of the lamp's life. The electrode terminals 6 are fixed to the outside part of end cap 3 which is similar to an end cap used in a common fluorescent lamp. The end cap 3 is attached to the glass envelope 13 by epoxy 21 or other similar composition. The only difference between end cap 3 and other commercially available lamp caps being the number and arrangement of these electrode terminals 6 and contacts 8. In order to harmonize this difference with commercially available sockets for fluorescent lamps, the end cap connector 2 provides means for connecting with these readily available sockets while making contact with one of the sets of electrode terminals 6, and consequently, one of the lamp enclosures 16 or 17 will be activated. The end cap connector 3 has a guide 10 that receives key 9 on end cap 3, thereby insuring a good fast contact. Lamp enclosure A 16 is separated from lamp enclosure B 17 by divider 14 which is shown to be made out of glass in the preferred embodiment but other suitable materials may be used. Longitudinal divider 14 may be formed in a similar fashion as glass grown base 5 is formed. The shape of divider 14 will depend upon the number of enclosures formed. For instance, if there are three enclosures the divider's cross-section will have a Y-shape, if there are four enclosures it would have an X-shape, etc. The preferred embodiment shows a cylindrical envelope but it is likely that the present invention will be produced as a superimposition of two cylindrical tubes, forming an 8-shaped cross-section. But the idea is the same and the shape of the tube will respond to usual production line capabilities. Each one of the enclosures, 16 and 17, will be an independent fluorescent lamp.

The user will have to rotate end cap connector 2, on each end of the dual lamp 1, whenever he decides to change from one lamp enclosure to the other one. The enclosure to be activated will always end up situated so that it gives out the maximum amount of light, i.e. downwardly, if the area to be illuminated is below. This may also be accomplished if more than two enclosures 16 and 17, are used. The glass envelope 13 rotates but the connector 2 position relative to the commercially available socket to which it is connected is fixed for the lamps having more than one pin 11. Lamps with only one pin 11 will obviously present no problem since they can be readily rotated.

Figure 4:
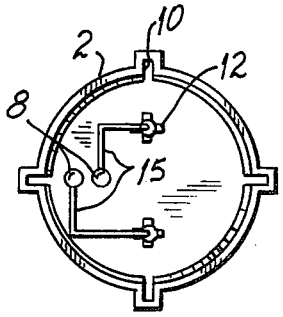
FIG. 4 shows the interconnections inside the end cap as seen from line 4—4.
Figure 2A:
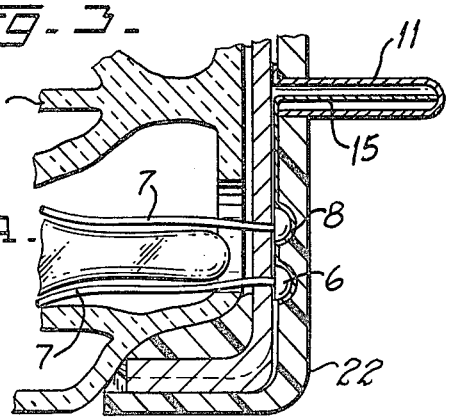
FIG. 2A is an exploded view of a portion of FIG. 2 with the end cap connector attached.
Figure 5:
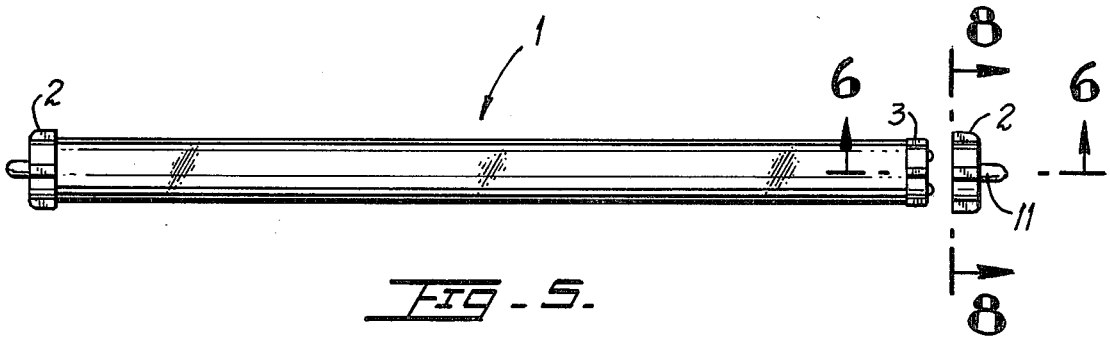
FIG. 5 is similar to FIG. 1 with the only difference being that the end cap connector has only one contact, as is the case with some commercially available lamps.

FIG. 4 shows the inner part of the end cap connector 2 where the end of contact pins 11 are riveted at 12 and connected through conductor 15 to contacts 8. The outer wall 22 of connector 2 looks like any commercially available lamp and it is capable of being inserted in any standard socket. Guides 10 and keys 9 insure a proper connection, improve mechanical stability of the assembly and impede rotation of the end cap connector 2.

FIG. 2 also shows a peripheral groove 19 formed between end cap 3 and glass envelope 13. This peripheral groove 19 receives rim 18 formed on the inner wall 23 of end cap connector 2, thereby providing a quick-connect snap action connection. Groove 19 may also be formed on the peripheral side wall of end cap 3.

Another commercially available type of fluorescent lamp using only one contact pin is illustrated in FIGS. 5 through 8, showing how the present invention can be incorporated, in a similar fashion as with the standard two pin type.

Figure 6:
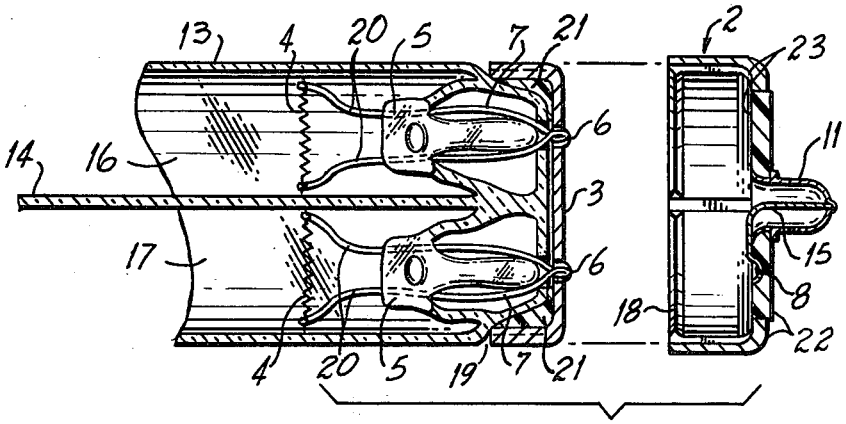
FIG. 6 is partial cross-section of the tube illustrated in FIG. 5 along line 6—6.
Figure 7:
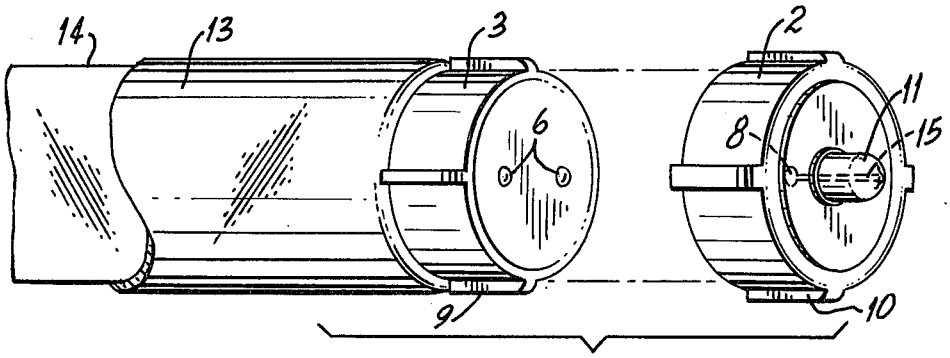
FIG. 7 is a partial view in perspective of the end of the lamp tube, with the end cap connector separated.
Figure 8:
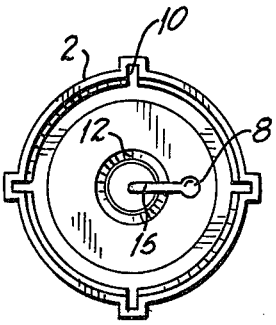
FIG. 8 shows the interconnection inside the end cap connector as seen from line 8—8.

From FIG. 6, it can be observed that pin 11 is connected via conductor 15 to contact 8 which is in receivable alignment with electrode terminals 6. Electrode terminals 6 are connected to electrode wires 7 and the circuit is completed with filament 4. Connector 2 receives end cap 3 connecting terminals 6 with contacts 8.

The user will have to turn each connector 2 on each end one-half turn in order to activate the other enclosure.

It is believed the foregoing description conveys the best understanding of the objects and advantages of the present invention. Different embodiments may be made of the invention herein described without departing from the inventive concept of the present invention. It is to be understood that all matter disclosed herein is to be interpreted merely as illustrative, and not in a limiting sense, except as set forth in the following appended claims.

NUMERAL REFERENCES FOR DRAWINGS

1. Fluorescent lamp
2. End cap connector
3. Ed cap
4. Filament
5. Glass grown base
6. Electrode terminals
7. Electrode wire
8. Contacts
9. Key
10. Guide
11. Contact pins
12. Contact pin rivet
13. Glass envelope
14. Divider
15. Conductor
16. Lamp enclosure A
17. Lamp enclosure B
18. Rim
19. Peripheral groove
20. Electrode assembly
21. Epoxy
22. Outer wall
23. Inner wall

What I claim is:

1. In a fluorescent lamp of the type having a longitudinally hermetically sealed glass envelope containing a rarified atmosphere wherein the improvement comprises:

(a) a longitudinal divider inside said glass envelope defining a plurality of hermetically independent enclosures, (b) a plurality of electrode assemblies each one attached to one end of each one of said enclosures, (c) a pair of end caps each one attached to each end of said envelope and having a plurality of electrode terminals connected to said electrode assemblies, (d) a pair of end cap connectors removably attached to said end caps having a standard set of contact pins protruding through the outer wall of said connector capable of plugging in commercially available sockets and the inner wall having a set of contacts in alignment with said electrode terminals and electrically connected to said pins.

2. The improvement described in claim 1 further comprising means for guiding said connector over said end cap thereby insuring the alignment of said electrode terminals with said contacts.

3. The improvement described in claim 2 further comprising means for locking said connector to said end cap.

4. The improvement described in claim 3 wherein said means for locking said connector to said end cap includes a peripheral rim on said inner wall of said connector and a peripheral groove integrally formed on the outer periphery of said end cap.

5. The improvement described in claim 4 wherein said peripheral groove is defined by the interface between said glass envelope and said end cap.

6. The improvement described in claim 5 wherein said means for guiding said connector further includes a guide integrally built on the peripheral wall of said connector and a key integrally built on the peripheral wall of said end cap.

* * * * *